United States Patent [19]

Zachariasen

[11] Patent Number: 4,697,385

[45] Date of Patent: Oct. 6, 1987

[54] SAFETY DOOR UNIT AND ROTATION GUIDE AND SUPPORT DEVICE FOR DOOR

[76] Inventor: Janine M. Zachariasen, Ancien Chemin de Cailly Houppeville, 76770 Malaunay, France

[21] Appl. No.: 712,688

[22] PCT Filed: Jun. 21, 1984

[86] PCT No.: PCT/FR84/00158

§ 371 Date: Mar. 6, 1985

§ 102(e) Date: Mar. 6, 1985

[87] PCT Pub. No.: WO85/00194

PCT Pub. Date: Jan. 17, 1985

[30] Foreign Application Priority Data

Jun. 24, 1983 [FR] France ..... 83 10434

[51] Int. Cl.[4] ..... E05B 65/10

[52] U.S. Cl. ..... 49/141; 16/229; 49/193

[58] Field of Search ..... 49/141, 382, 384, 193, 49/381; 16/229, 262, 386

[56] References Cited

U.S. PATENT DOCUMENTS

| | | | |
|---|---|---|---|
| 1,641,036 | 8/1927 | Jachimstal | 16/229 |
| 1,932,552 | 10/1933 | Lutz | 16/229 |
| 1,972,575 | 9/1934 | Schmidt | 49/193 |
| 2,369,148 | 2/1945 | Langhorst | 16/229 |
| 2,955,314 | 10/1960 | Tylman | 16/229 |
| 3,166,367 | 1/1965 | Vincens | 16/229 X |
| 3,940,886 | 3/1976 | Ellingson, Jr. | 49/141 X |
| 3,946,460 | 3/1976 | Johnson | 49/141 X |

FOREIGN PATENT DOCUMENTS

| | | | |
|---|---|---|---|
| 42844 | 8/1930 | Denmark | 49/193 |
| 467957 | 6/1914 | France . | |
| 646181 | 11/1928 | France . | |
| 2411944 | 7/1979 | France . | |
| 29755 | of 1915 | United Kingdom | 16/229 |
| 463612 | 4/1937 | United Kingdom . | |

*Primary Examiner*—Philip C. Kannan

*Attorney, Agent, or Firm*—Steele, Gould & Fried

[57] ABSTRACT

A door pivotable open in one direction is made unhingeable from an opposite side. The door is mounted in a door frame having stop molding rebates disposed on different sides of the door for the left and right sides of the frame, and no stop molding or rebate on the top. The door is hinged at the left or right side by means of a mating pivot pin and receptacle in the door and frame or vice versa. A mechanism is accessible at least on the outer face of the door when the door is closed, to disengage the hinge parts and release the door. The door can also include alternative hinges on opposite edges of the door, the door being openable when one set of hinges is disengaged.

5 Claims, 29 Drawing Figures

Figure 1:
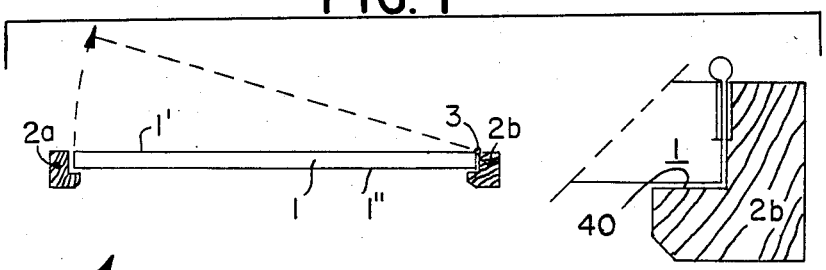

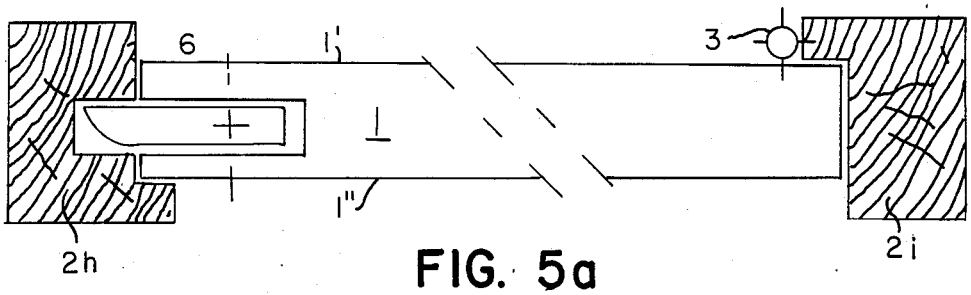
FIG. 5a
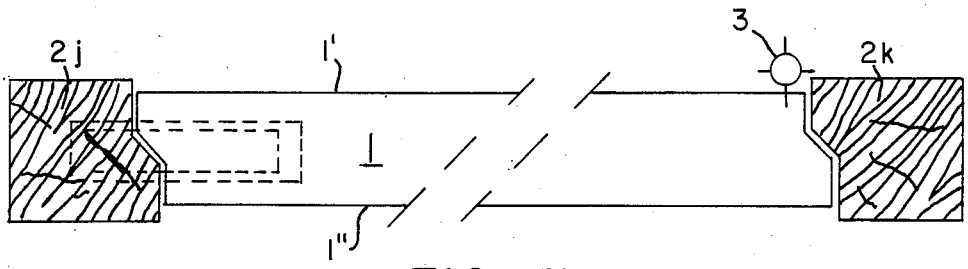
FIG. 5b
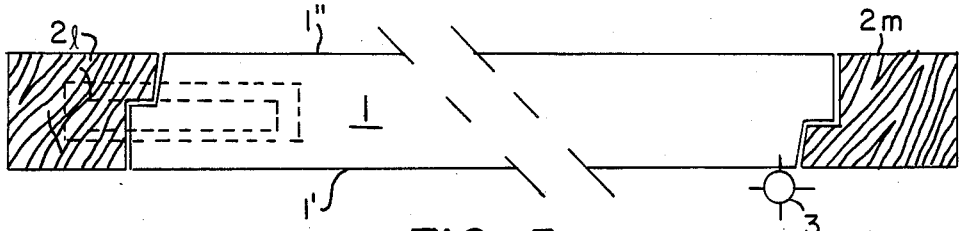
FIG. 5c
FIG. 6a
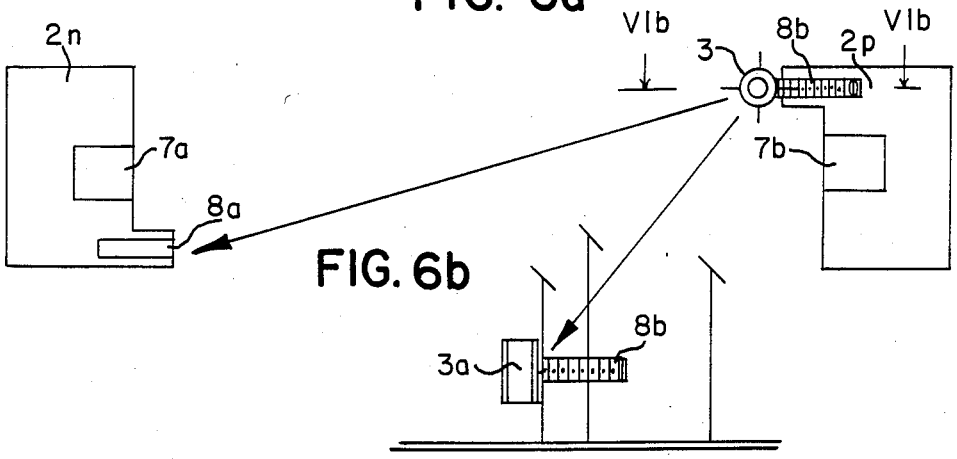
FIG. 6b

FIG. 7
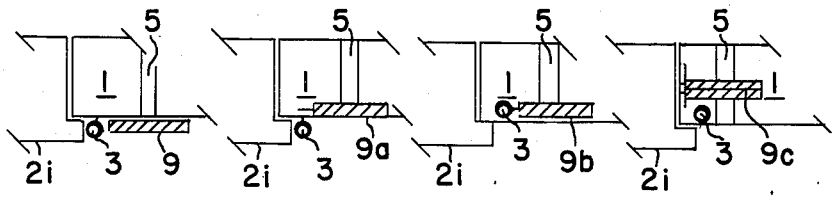
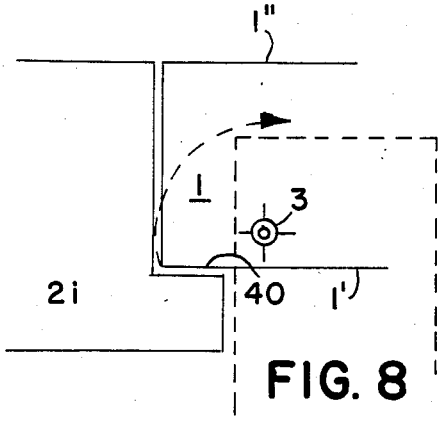
FIG. 8
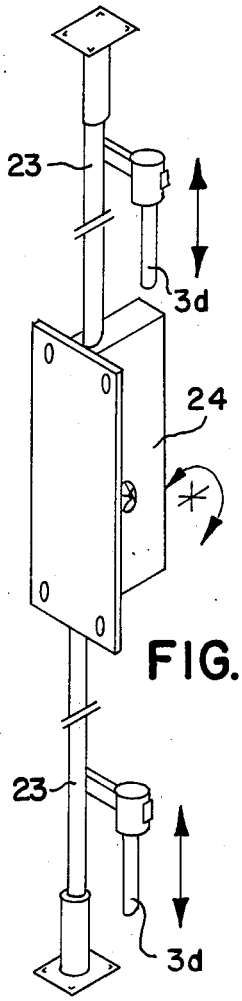
FIG. 12
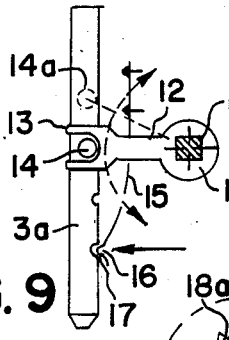
FIG. 9
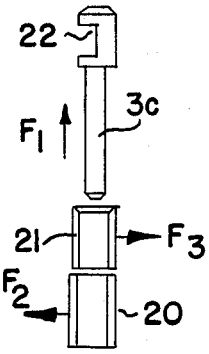
FIG. 11
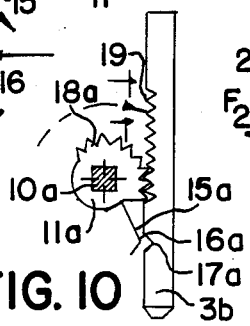
FIG. 10

SAFETY DOOR UNIT AND ROTATION GUIDE AND SUPPORT DEVICE FOR DOOR

The present invention relates, in general terms, to new door-block structures and supporting and rotary-guidance devices for doors, which improve the safety of persons.

Door frames used at the present time have high left and right rebates, which are oriented in the same direction, that it to say they allow the door to be opened only inwards or outwards, and the supporting and rotary-guidance devices, hinge pins, hinge plates or pivots which conventionally equip doors, are fixed and are located on the inside in relation to the normal opening direction, but it is not possible to unhinge a closed door from the outside. "Rebate" as used herein refers to the door-stopping molding or the like affixed to inward-facing surfaces of a door frame and forming a rabbet or edge against which the door rests when closed.

Now, such a possibility of unhinging would be entirely desirable, for example in order to free a child which has locked or bolted itself in a room and which no longer knows how to open the door, or in order to open a closed room via a door the lock of which is blocked.

For this purpose, the invention provides a new supporting and rotary-guidance device comprising at least one first receiving element designed to be fixed to the casing and a second receiving element designed to be fixed to the door, the two elements being capable of matching with one another and of being connected by means of a pivot inserted along their longitudinal axis, this device being characterised in that it incorporates control means accessible at least from the outer face of the door in relation to its normal opening direction and releasing the said pivot from one of the said receiving elements.

To do this, the control means can act either or the male part (pivot) or the female part (receiving element) of the device.

Thus, it is possible, from outside the room, to separate the two elements of the device, even though the latter is located on the other side of the door in relation to the person taking action.

In a preferred embodiment, the control means of the pivot are also accessible from the inner face of the door, so that a person shut in a room, the lock of which no longer operates, can free himself or herself.

It is also known that it is not unusual for persons to be taken ill in confined rooms, such as toilets or bathrooms, and if they happen to fall behind the door which opens inwards into the room it is impossible to rescue them without breaking open the door.

To remedy this situation, in recent blocks of flats the doors of such rooms open outwards. However, the disadvantage of this solution is that it makes it difficult to allow free movement in the coridoors which have to be widened at the expense of the habitable area; moreover, in old blocks of flats, it is often impossible to install statutory sanitary rooms because of a lack of space.

The object of the present invention is to overcome these disadvantages by making it possible to unhinge from outside a door which normally opens inwards, and for this purpose its subject is a safety door block which comprises, on the one hand, a casing which has no high rebate and the left and right rebates of which have a reversed profile, and, on the other hand, a door hinged on one side of the said casing by means of at least one pair of devices of the type mentioned above.

Because the high rebate is omitted and the profiles of the right and left rebates are reversed, the casing does not prevent the unhinged door from being removed outwards.

The invention is also used to reverse the opening direction of a door according to requirements, in which case the door can be hinged to the casing, which has no high rebate and the rebates of which have a reversed profile, in such a way that it normally opens inwards if this does not present any special problem for the user, whilst it can be hinged so as to open outwards if the flat is occupied, for example, by a handicapped person.

Another use of the invention is the production of a safety door block incorporating a fire-proof door capable of being opened outwards or inwards, depending on the direction of movement of persons present in the room to be evacuated.

For this purpose, the door block comprises, firstly, a casing which has no high rebate and the left and right rebates of which have a reversed profile, secondly a fire-proof door hinged to the said casing both on the right side and on the left side by means of devices of the type mentioned above, in relation to the direction of the push exerted on the fire-proof door, thirdly a pair of anti-panic opening bars arranged respectively on one side of the door and on the other side and designed to disengage the pivots of the devices located on the side of the frame which allows the door to be opened in the direction of the push exerted on one opening bar or the other, and fourthly locking means actuated by that opening bar which was the first to be pushed and blocking the other bar.

Whatever the particular use of the invention, the control means releasing the pivots can consist of a piece which has a cut-out designed to receive an operating member, such as a square or a male or female triangle, a key, a screwdriver or even a coin, and which is connected to, incorporates or allows access to drive means which engage with the said pivot or with its receiving element.

These drive means, which can also be controlled by means of a lock or key bolt or by any other means, can comprise a rack, lever, eccentric, spring, endless screw or any other equivalent mechanism.

When a pair of devices of the type mentioned above equips the lower and upper parts of the door respectively, the control means can consist of an espagnolette i.e., a hasp device as used in french windows, characterized by a bar extending across the door and controlling lower and upper closure rods, the lower and upper rods of which are designed respectively to release the pivot from the lower and upper devices.

Finally as a result of a suitable modification, the invention makes it possible to unhinge outwards a door with a conventional casing, which normally opens inwards.

The invention will be understood better from a reading of the following description made with reference to the attached drawings in which:

FIG. 1 is a sectional view of a door in its conventional casing, with the right rebate being enlarged.

Figure 2:
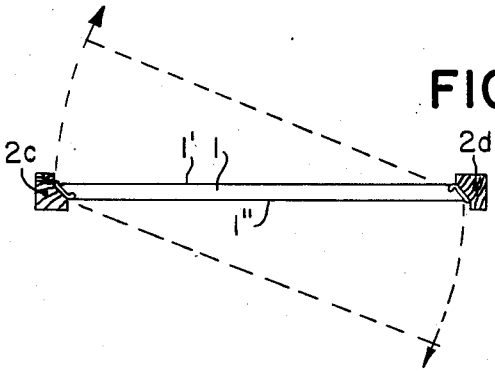
Figure 3:
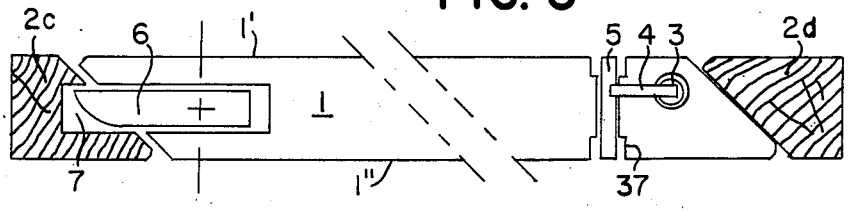
Figure 4A:
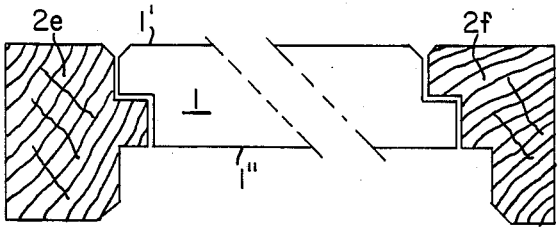
Figure 4B:
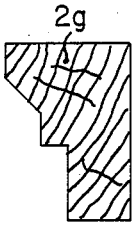
Figure 13A:
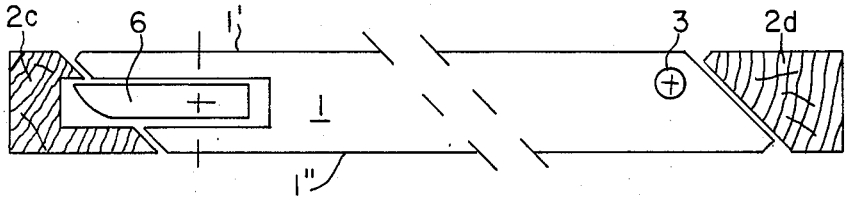
Figure 13B:
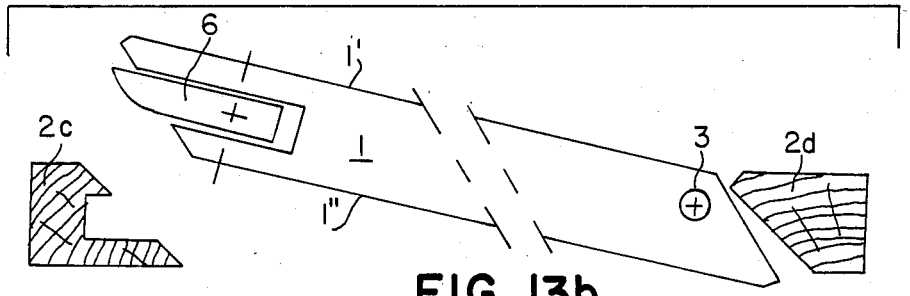
Figure 13C:
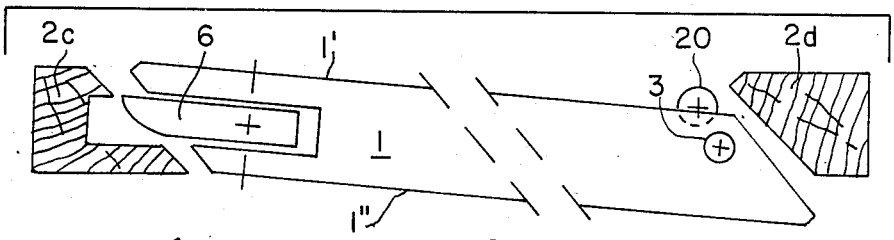
Figure 13D:
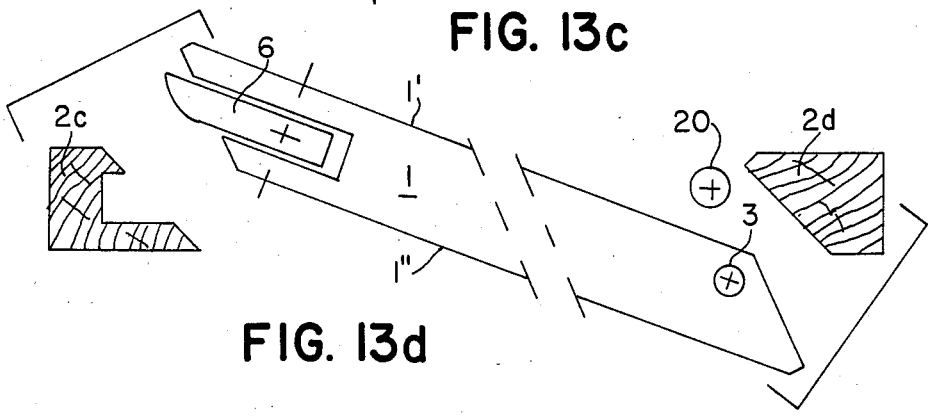
Figure 14A:
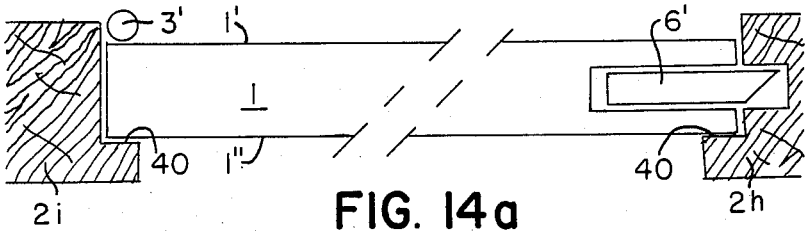
Figure 14B:
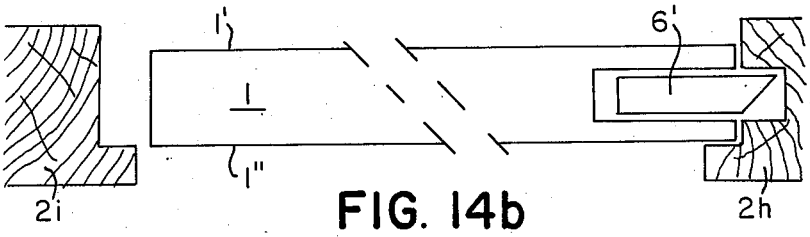
Figure 14C:
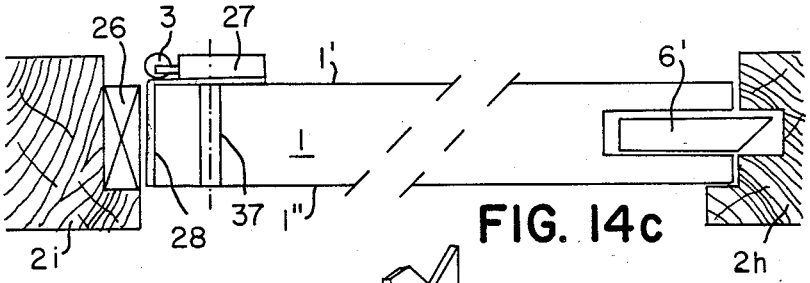
Figure 15:
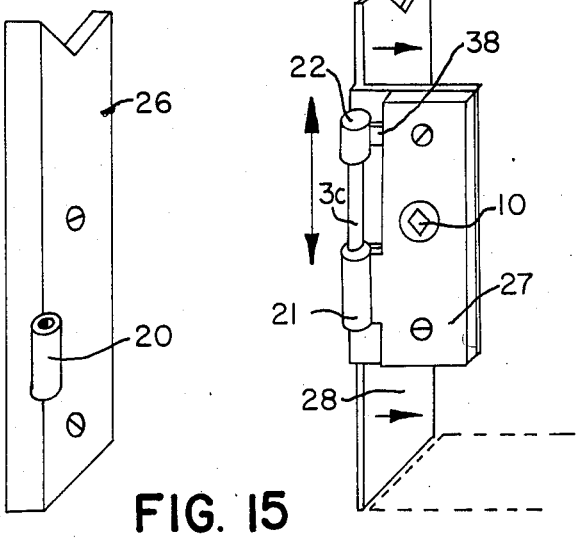
Figure 16A:
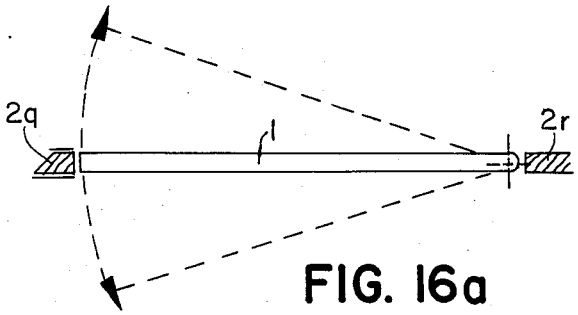
Figure 16B:
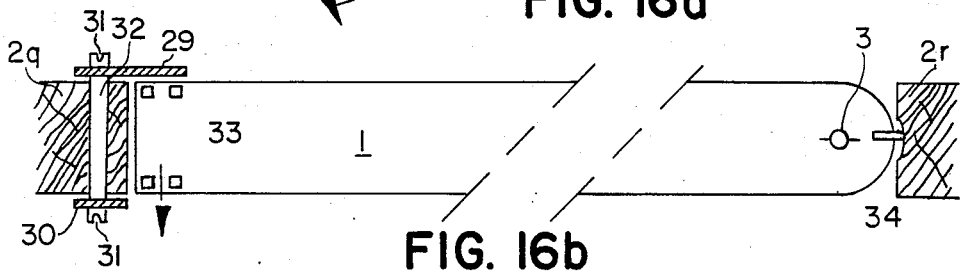
Figure 16C:
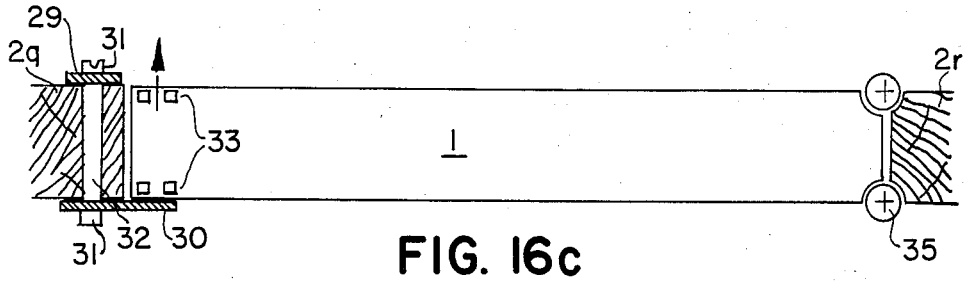
Figure 17:
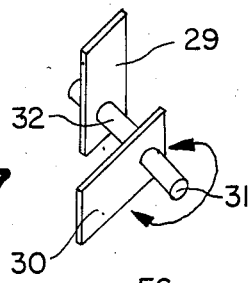
Figure 18:
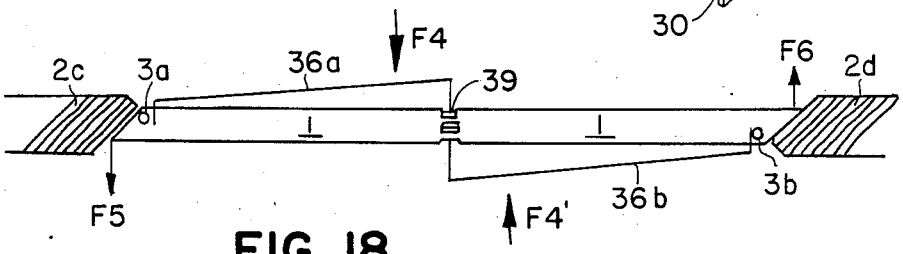

FIG. 2 shows a basic diagram of the safety door block according to the invention, FIG. 3 shows in detail the door block according to one of the embodiments, FIGS. 4*a* and 4*b* show frames having rebates with a reversed opening profile, FIGS. 5*a* to 5*c* show other forms of angular frames with a reversed opening profile, FIGS. 6*a* and 6*b* show respectively a frame prepared for the hinging of the door on the left post or the right post for the purpose of reversing the opening direction, and a section taken along the line VIb—VIb of FIG. 6*a*, FIG. 7 shows the various positions of the unhinging control, FIG. 8 indicates the position of the unhinging pivots in the case of a fitting which allows a 90° opening, FIGS. 9 and 10 show alternative embodiments of the drive means for the pivots, FIG. 11 shows the removal of the pivot and unhinging, FIG. 12 illustrates an alternative embodiment which makes use of an espagnolette for removing the pivot, FIGS. 13*a* to 13*d* illustrate the various stages in the unhinging of a door according to the invention, FIGS. 14*a* to 14*c* show how the technique according to the invention is modified for an existing door block of the prior art, FIG. 15 shows in perspective the device used in FIG. 14*c*, FIG. 16*a* shows a form of a door using a frame without a rebate, and FIGS. 16*b* and 16*c* show the use of a stop cam which makes it possible to give such a door an opening direction, FIG. 17 is a perspective view of a stop cam of FIGS. 16*b* and 16*c* and, FIG. 18 shows how the invention is modified so as to produce a fire-proof door block.

Referring to FIG. 1, it will be seen that a door 1 is mounted on a conventional casing, the frames 2*a* and 2*b* of which have rebates 40 in the same direction. The pivot 3 is fixed and is located on the same side as the inner face 1′ of the door, so that it is impossible to unhinge it from the outer face 1″.

FIG. 2 shows a door 1 mounted in a casing according to the invention, that is to say such that the frames 2*c* and 2*d* have rebates, the profile of which is reversed. Such a casing makes it possible to hinge the door 1 either on the frame 2*c* or on the frame 2*d*, so that the door can open in one direction or the other. FIG. 2 indicates diagrammatically the presence of one pivot on the right and another on the left, one serving as a hinge and the other as a lock.

Referring now to FIG. 3, the door 1 is closed and has its inner face 1′ and its outer face 1″, the two frames of the casing 2*c* and 2*d* and the pivot 3. Reference symbol 4 denotes a member driving the pivot 3, and reference symbol 5 designates a member controlling the drive member 4. Examples of the relationship between the control member, drive member and pivot are illustrated in FIGS. 9, 10, 12 and 15 described later. The control member 5 is accommodated in a perforation 37 provided for this purpose in the door, and it is accessible both from the outer face 1″ and from the inner face 1′ of the door. Reference symbol 6 denotes the latch of the lock.

It will be understood that by operating the member 5, for example from the face 1″ of the door, and consequently the member 4, the pivot 3 can be lifted and the door unhinged and then removed outwards because the profiles of the rebates of the frames 2*c* and 2*d* are reversed.

FIGS. 4*a*, 4*b*, and 5*a* to 5*c* show various possibilities for producing frame casings (2*e*, 2*f*); 2*g*; 2*h*, 2*i*; 2*j*, 2*k*; 2*l*, 2*m*) having rebates, the profile of which is reversed and the form of which depends on whether the door itself will have a rebate.

FIGS. 6*a* and 6*b* show a casing, the posts 2*n* and 2*p* of which have rebates the profiles of which are exactly opposite to one another. This rebate has a cut-out 7*a* and 7*b* respectively for the latch of the lock, and a perforation 8*a* and 8*b* respectively for screwing a threaded rod carrying the female part 3*a* of the hinge designed to receive the pivot 3. It is sufficient to unscrew the element 3*a* from the frame 2*p* and screw it into the perforation 8*a* of the frame 2*n* again to reverse the opening direction of the door.

FIG. 7 shows various positions of the unhinging control: built-on 9, semi-inset 9*a*, inset 9*b* and mortised 9*c*. It will be noted that the controls 9, 9*a* and 9*b* correspond to the housing 27 of FIG. 15 and that the control 9*c* corresponds to the member 4 of FIG. 3.

FIG. 8 shows the location where the inset pivot 3 must necessarily be fitted to ensure that the door 1 can open 90°.

Various embodiments of the mechanism for removing the pivot 3 are given in FIGS. 9 to 12.

In FIG. 9, a square cut-out 10 is provided in a piece 11 which is extended in a lever arm 12, the fork 13 of which engages with a stud 14 provided on the pivot 3*a*. When the piece 11 is rotated by means of a suitable operating member introduced into the cut-out 11, the stud is pushed up to 14*a*, thus lifting the pivot 3*a*. A spring leaf 15 is designed to retain the pivot 3*a* in position as a result of the penetration of its retaining finger 16 into notches 17 provided on the pivot 3*a*.

In FIG. 10, the square cut-out 10*a* is made in a piece 11*a*, the partially toothed periphery 18*a* of which is designed to engage with a corresponding toothed zone 19 provided on the pivot 3*b*. As in the embodiment of FIG. 9, a spring leaf 15*a* having a retaining finger 16*a* is designed to retain the pivot 3*b* as a result of penetration into a suitable notch 17*a*.

It goes without saying that the cut-out 10 or 10*a* is not necessarily square; it can assume any form capable of being actuated and can even be confined to a simple slot.

FIG. 11 indicates the unhinging of the door as a result of the lifting of the pivot 3*c* according to the arrow F1 and the separation according to the arrows F2 and F3 of the first element 21 and second element 20 of a hinge which will be described in detail with reference to FIG. 15.

Another alternative embodiment is illustrated in FIG. 12, in which the mechanism driving the pivots 3*d* in the directions indicated by arrows includes the rods 23 of an espagnolette designated as a whole by 24. Rods 23 can be drivable up and down by a mechanism such as shown in FIGS. 9 and 10.

Referring now to FIGS. 13*a* to 13*d*, the various stages in the unhinging of a door will be seen.

FIG. 13*a* shows the door closed,

FIG. 13*b* shows the door in a normal opening state, in FIG. 13*c*, the pivot 3 has been removed from the female element 20 attached to the frame 2*d*;

in FIG. 13*d*, the door 1 is being removed from the casing. It will be understood that this removal is possible only because of the use of a casing 2*c*, 2*d* which has no high rebate and the left and right rebates of which have a reversed profile.

FIGS. 14*a* to 14*c* show how the technique according to the invention is modified for an existing door block.

FIG. 14*a* shows a door 1 hinged at 3' on a frame 2*i*, whilst its latch 6' penetrates into a frame 2*h*. This door can only open inwards, since the rebates 40 of the frames 2*i* and 2*h* and the high rebate, which cannot be seen in the drawing, oppose the outward pivoting of the door 1. To modify such a door block in keeping with the technique according to the invention, it is sufficient to unhinge the door 1 and saw off the edge of the door and the upper part of the door over a similar width: the structure illustrated in FIG. 14*b* is then obtained. The rebate of the frame 2*i* is partially filled by a batten 26 which carries the female element of the hinge (FIG. 15). The high rebate is also partially filled by a suitable batten. The angle (FIG. 14*c*) of the door 1 is itself fitted with a housing 27 mounted on a reinforcing bracket 28: in fact, it is necessary to reinforce the angle of the door, since the sawing of the latter has eliminated a considerable portion of the reinforcing block of the isoplane structure. The door 1 will have been perforated beforehand according to 37, so as to allow access from the face 1'' to the cut-out 10 (FIG. 15), which makes it possible to actuate the piece (not shown in the Figure) capable of actuating the bar 38 which engages with the notch provided (FIG. 11) in the head 22 of the pivot 3*c* to lift the latter and remove it from the female element 20.

Instead of sawing the door, it could very easily be left as it is, and the left rebate 40 and high rebate could be sawn off. In this case, there will be no need for the batten 26 and the reinforcing bracket 28, the housing 27 could be mounted directly on the door and the female element 20 on the frame 2*i* from which the rebate has been eliminated.

FIG. 16*a* shows a door 1 mounted to swing in a casing 2*q*, 2*r* without a rebate. To make it possible temporarily to prevent such a door from pivoting inwards or outwards, the invention proposes to provide the frame 2*q* with the locking member shown separately in FIG. 17. This blocking member constituting a stop cam comprises a pin 32 to which are attached at 90° two metal plates 29 and 30 capable of occupying three positions: the projecting part of the plate 29 can perform its function, whilst the projecting part of the plate 30 is retracted (FIG. 16*b*), or vice versa (FIG. 16*c*), or the projecting parts of the two plates can be retracted at the same time, thus rendering the blocking device inoperative (as in FIG. 16*a*). A slot 31 provided at each end of the pin 32 makes it possible to rotate the blocking member and modify the orientation of the plates 29 and 30 according to the desired opening direction for the door. In FIGS. 16*b* and 16*c*, reference symbol 33 denotes magnets designed to retain the closed door against the metal plate 29. Reference symbol 34 in FIG. 16 designates a sealing brush strip, and reference symbol 35 in FIG. 16*c* denotes a double-action hinge.

FIG. 18 shows a fire-proof door mounted on pivots 3*a* and 3*b* by means of devices of the type described above, the frames 2*c* and 2*d* having a reversed rebate. The door 1 is provided, on each of its faces, with an anti-panic opening bar 36*a*, 36*b* which constitutes the means of controlling the drive means for the pivots 3*a* and 3*b*. A locking device 39 is provided, so that as soon as pressure is exerted on one of the anti-panic opening bars 36*a* or 36*b* the other bar is blocked. Thus, in the event of evacuation according to the arrow F4, a push will be exerted on the bar 36*a*, the effect of which will be unhinging on the side 2*c*, and the door will open according to the arrow F5.

If, on the contrary, the push were exerted on the bar 36*b* according to the arrow F4', this would cause unhinging on the side 2*d* and the door would open according to the arrow F6.

By lifting one of the opening bars 36*a* and 36*b*, a person can unhinge the door and remove it towards himself, a push on the bars causing the door to open, as indicated above.

The use of the invention in fire-proof doors also offers the following advantages:

- the oblique form of the posts prevents the door from being jammed in the casing in the event of expansion,
- the door can be unhinged from inside or from outside,
- smoke-proofing is reinforced by expansion if the door block is made of metal,
- the casing is designed in such a way that the posts do not become thermal bridges,
- the use of pins forming the pivots, together with washers made of Babbitt metal which melt in the event of a critical increase in temperature, prevent the hinges from jamming.

It goes without saying that the invention is not limited to the embodiments described and illustrated. In particular, the rebates can have different forms and be of greater or lesser depth, depending on whether the casing is made of wood, metal or plastic and whether it is removable where appropriate. They can be swing-to, have an attached stop or have a stop with a flat or curved moveable cam. The doors can have a rebate or not depending on the material used (wood, metal, plastic or tempered glass). The doors can be fitted on a male pivot or a female junction piece. The hinges can either be inset or project. The lock, projecting or inset, can be provided with blocking of the latch during opening to make it easier to remove the door.

It imerges from the foregoing description that the invention provides new means ensuring the safety of persons, making it possible to reverse the opening direction of doors according to requirements and being simple and economical to modify for existing structures.

I claim:

1. A supporting and guidance device for a pivotally mounted door, comprising:

a casing having no rebate at a top thereof and having left and right rebates along opposite sides of the casing, the left and right rebates defining stops on opposite sides of the door, the rebates having a reversed profile from one another;

hinge means pivotally mounting the door at one side of the casing, including a first connecting element fixed to the casing and a second connecting element fixed to the door, the first and second connecting elements being rotatably connectable to one another to define a pivot along a longitudinal hinging of the door in the casing, thereby pivotally mounting the door to open in a first opening direction relative to the casing, whereupon a first edge of the door is moved away from one of said left and right rebates; and, control means accessible from an outer face of the door when the door is closed to said first opening direction, the control means being operable to disconnect the first and secon connecting elements from one another, whereby the pivot is released and the door is released from the casing along the hinge axis, whereby the door is made openable in a direction opposite said first opening direction, and whereupon a second edge of the door opposite said first edge is moved away from the other of said left and right rebates.

2. The device of claim 1, wherein the control means includes a piece having a cut-out adapted to receive an operating member, said piece being connected to drive means engaging with said first and second connecting elements defining the pivot and the drive means being operable to disconnect the first and second connecting elements from one another.

3. The device of claim 1, further comprising a further device also having a first connecting element and a second connecting element, said device and said further device respectively equipping lower and upper parts of a door mounted on a casing having no high rebate but having side rebates, and wherein the control means includes an espagnolette having lower and upper rods movable by a vertical bar, the lower and upper rods of the espagnolette being operable respectively to release pivots from the device and the further device at upper and lower edges of the door.

4. The device of claim 1, wherein the control means includes a piece having a cut-out capable of receiving an operating member, the piece incorporating drive means engaging with the pivot.

5. The device of claim 1, wherein the control means includes a piece having a cut-out capable of receiving an operating member, the piece giving access to drive means engaging with the pivot.

* * * * *

UNITED STATES PATENT AND TRADEMARK OFFICE

CERTIFICATE OF CORRECTION

PATENT NO. : 4,697,385

DATED : October 6, 1987

INVENTOR(S) : Zachariasen

It is certified that error appears in the above-identified patent and that said Letters Patent is hereby corrected as shown below:

Column 1, line 11, delete "it" and insert --is--.

Column 1, line 39, delete "or" and insert --on--.

Column 6, line 66, delete "secon" and insert --second--.

Signed and Sealed this

Twelfth Day of July, 1988

*Attest:*

DONALD J. QUIGG

*Attesting Officer*

*Commissioner of Patents and Trademarks*